US010262814B2

(12) United States Patent
Hendren et al.

(10) Patent No.: US 10,262,814 B2
(45) Date of Patent: Apr. 16, 2019

(54) LOW TRAVEL SWITCH ASSEMBLY

(71) Applicant: Apple Inc., Cupertino, CA (US)

(72) Inventors: Keith J. Hendren, Cupertino, CA (US); Thomas W. Wilson, Jr., Saratoga, CA (US); John M. Brock, Cupertino, CA (US); Craig C. Leong, Cupertino, CA (US); James J. Niu, Cupertino, CA (US); Satoshi Okuma, Fujiyoshida (JP); Shinsuke Watanabe, Fujiyoshida (JP)

(73) Assignee: APPLE INC., Cupertino, CA (US)

( * ) Notice: Subject to any disclaimer, the term of this patent is extended or adjusted under 35 U.S.C. 154(b) by 23 days.

(21) Appl. No.: 15/230,740

(22) Filed: Aug. 8, 2016

(65) Prior Publication Data

US 2016/0343523 A1 Nov. 24, 2016

Related U.S. Application Data

(63) Continuation of application No. 14/287,915, filed on May 27, 2014, now Pat. No. 9,412,533.

(60) Provisional application No. 61/827,708, filed on May 27, 2013.

(51) Int. Cl.

| | |
|---|---|
| ***H01H 13/14*** | (2006.01) |
| ***H01H 65/00*** | (2006.01) |
| ***H01H 13/48*** | (2006.01) |
| ***H01H 13/52*** | (2006.01) |
| ***H01H 13/70*** | (2006.01) |
| ***H01H 13/85*** | (2006.01) |

(52) U.S. Cl.

CPC ..... *H01H 13/14* (2013.01); *H01H 13/48* (2013.01); *H01H 13/52* (2013.01); *H01H 13/70* (2013.01); *H01H 13/85* (2013.01); *H01H 65/00* (2013.01); *H01H 2215/004* (2013.01); *H01H 2223/042* (2013.01); *H01H 2229/05* (2013.01); *Y10T 29/49204* (2015.01)

(58) Field of Classification Search

CPC ..... H01H 13/14; H01H 65/00; H01H 13/48; H01H 13/52; H01H 13/70; H01H 13/85

USPC ..... 200/512, 513, 517

See application file for complete search history.

(56) References Cited

U.S. PATENT DOCUMENTS

| | | | |
|---|---|---|---|
| 3,657,492 | A | 4/1972 | Arndt et al. |
| 3,917,917 | A | 11/1975 | Murata |
| 3,978,297 | A | 8/1976 | Lynn et al. |

(Continued)

FOREIGN PATENT DOCUMENTS

| | | |
|---|---|---|
| CN | 2155620 | 2/1994 |
| CN | 2394309 | 8/2000 |

(Continued)

OTHER PUBLICATIONS

U.S. Appl. No. 15/615,806, filed Jun. 6, 2017, pending.

(Continued)

*Primary Examiner* — Kyung S Lee

(74) *Attorney, Agent, or Firm* — Dorsey & Whitney LLP

(57) ABSTRACT

A low travel switch assembly and systems and methods for using the same are disclosed. The low travel dome may include a domed surface having upper and lower portions, and a set of tuning members integrated within the domed surface between the upper and lower portions. The tuning members may be operative to control a force-displacement curve characteristic of the low travel dome.

20 Claims, 12 Drawing Sheets

(56) References Cited

U.S. PATENT DOCUMENTS 4,084,071 A * 4/1978 Smith ..... H01H 13/7013 200/1 R
4,095,066 A 6/1978 Harris
4,319,099 A 3/1982 Asher
4,349,712 A 9/1982 Michalski
4,484,042 A 11/1984 Matsui
4,596,905 A 6/1986 Fowler
4,598,181 A 7/1986 Selby
4,670,084 A 6/1987 Durand et al.
4,755,645 A 7/1988 Naoki et al.
4,937,408 A 6/1990 Hattori et al.
4,987,275 A 1/1991 Miller et al.
5,021,638 A 6/1991 Nopper et al.
5,092,459 A 3/1992 Uljanic et al.
5,136,131 A 8/1992 Komaki
5,278,372 A 1/1994 Takagi et al.
5,280,146 A 1/1994 Inagaki et al.
5,340,955 A 8/1994 Calvillo et al.
5,382,762 A 1/1995 Mochizuki
5,397,867 A 3/1995 Demeo
5,408,060 A 4/1995 Muurinen
5,421,659 A 6/1995 Liang
5,422,447 A 6/1995 Spence
5,457,297 A 10/1995 Chen
5,477,430 A 12/1995 LaRose et al.
5,481,074 A 1/1996 English
5,504,283 A 4/1996 Kako et al.
5,512,719 A 4/1996 Okada et al.
5,625,532 A 4/1997 Sellers
5,804,780 A 9/1998 Bartha
5,828,015 A 10/1998 Coulon
5,847,337 A 12/1998 Chen
5,874,700 A 2/1999 Hochgesang
5,875,013 A 2/1999 Takahara
5,876,106 A 3/1999 Kordecki et al.
5,878,872 A 3/1999 Tsai
5,881,866 A 3/1999 Miyajima et al.
5,898,147 A 4/1999 Domzaiski et al.
5,924,555 A 7/1999 Sadamori et al.
5,935,691 A 8/1999 Tsai
5,960,942 A 10/1999 Thornton
5,986,227 A 11/1999 Hon
6,020,565 A 2/2000 Pan
6,068,416 A 5/2000 Kumamoto et al.
6,215,420 B1 4/2001 Harrison et al.
6,257,782 B1 7/2001 Maruyama et al.
6,259,046 B1 7/2001 Iwama et al.
6,377,685 B1 4/2002 Krishnan
6,388,219 B2 5/2002 Hsu et al.
6,423,918 B1 7/2002 King et al.
6,482,032 B1 11/2002 Szu et al.
6,530,283 B2 3/2003 Okada et al.
6,538,801 B2 3/2003 Jacobson et al.
6,542,355 B1 4/2003 Huang
6,552,287 B2 4/2003 Janniere
6,556,112 B1 4/2003 Van Zeeland et al.
6,559,399 B2 5/2003 Hsu et al.
6,560,612 B1 5/2003 Yamada et al.
6,572,289 B2 6/2003 Lo et al.
6,573,463 B2 6/2003 Ono
6,585,435 B2 7/2003 Fang
6,624,369 B2 9/2003 Ito et al.
6,706,986 B2 3/2004 Hsu
6,738,050 B2 5/2004 Comiskey
6,750,414 B2 6/2004 Sullivan
6,759,614 B2 7/2004 Yoneyama
6,762,381 B2 7/2004 Kunthady et al.
6,765,503 B1 7/2004 Chan et al.
6,788,450 B2 9/2004 Kawai et al.
6,797,906 B2 9/2004 Ohashi
6,850,227 B2 2/2005 Takahashi et al.
6,860,660 B2 3/2005 Hochgesang et al.
6,911,608 B2 6/2005 Levy
6,926,418 B2 8/2005 Ostergård et al.
6,940,030 B2 9/2005 Takeda et al.
6,977,352 B2 12/2005 Oosawa
6,979,792 B1 12/2005 Lai
6,987,466 B1 1/2006 Welch et al.
6,987,503 B2 1/2006 Inoue
7,012,206 B2 3/2006 Oikawa
7,030,330 B2 4/2006 Suda
7,038,832 B2 5/2006 Kanbe
7,126,499 B2 10/2006 Lin et al.
7,129,930 B1 10/2006 Cathey et al.
7,134,205 B2 11/2006 Bruennel
7,146,701 B2 12/2006 Mahoney et al.
7,151,236 B2 12/2006 Ducruet et al.
7,151,237 B2 12/2006 Mahoney et al.
7,154,059 B2 12/2006 Chou
7,166,813 B2 1/2007 Soma
7,172,303 B2 2/2007 Shipman et al.
7,189,932 B2 3/2007 Kim
7,256,766 B2 8/2007 Albert et al.
7,283,119 B2 10/2007 Kishi
7,301,113 B2 * 11/2007 Nishimura ..... H01H 13/48 200/406
7,312,790 B2 12/2007 Sato et al.
7,378,607 B2 5/2008 Koyano et al.
7,385,806 B2 6/2008 Liao
7,391,555 B2 6/2008 Albert et al.
7,414,213 B2 8/2008 Hwang
7,429,707 B2 9/2008 Yanai et al.
7,432,460 B2 10/2008 Clegg
7,510,342 B2 3/2009 Lane et al.
7,531,764 B1 5/2009 Lev et al.
7,541,554 B2 6/2009 Hou
7,589,292 B2 9/2009 Jung et al.
7,639,187 B2 12/2009 Caballero et al.
7,639,571 B2 12/2009 Ishii et al.
7,651,231 B2 1/2010 Chou et al.
7,679,010 B2 3/2010 Wingett
7,724,415 B2 5/2010 Yamaguchi
7,781,690 B2 8/2010 Ishii
7,813,774 B2 10/2010 Perez-Noguera
7,842,895 B2 11/2010 Lee
7,847,204 B2 12/2010 Tsai
7,851,819 B2 12/2010 Shi
7,866,866 B2 1/2011 Wahlstrom
7,893,376 B2 2/2011 Chen
7,923,653 B2 4/2011 Ohsumi
7,947,915 B2 5/2011 Lee et al.
7,999,748 B2 8/2011 Ligtenberg et al.
8,063,325 B2 11/2011 Sung et al.
8,077,096 B2 12/2011 Chiang et al.
8,080,744 B2 12/2011 Yeh et al.
8,098,228 B2 1/2012 Shimodaira et al.
8,109,650 B2 2/2012 Chang et al.
8,119,945 B2 2/2012 Lin
8,124,903 B2 2/2012 Tatehata et al.
8,134,094 B2 3/2012 Tsao et al.
8,143,982 B1 3/2012 Lauder et al.
8,156,172 B2 4/2012 Muehl et al.
8,178,808 B2 5/2012 Strittmatter et al.
8,184,021 B2 5/2012 Chou
8,212,160 B2 7/2012 Tsao
8,212,162 B2 7/2012 Zhou
8,218,301 B2 7/2012 Lee
8,232,958 B2 7/2012 Tolbert
8,246,228 B2 8/2012 Ko et al.
8,253,048 B2 8/2012 Ozias et al.
8,253,052 B2 9/2012 Chen
8,263,887 B2 9/2012 Chen et al.
8,289,280 B2 10/2012 Travis
8,299,382 B2 10/2012 Takemae et al.
8,317,384 B2 11/2012 Chung et al.
8,319,298 B2 11/2012 Hsu
8,325,141 B2 12/2012 Marsden
8,330,725 B2 12/2012 Mahowald et al.
8,354,629 B2 1/2013 Lin
8,378,857 B2 2/2013 Pance
8,383,972 B2 2/2013 Liu
8,384,566 B2 2/2013 Bocirnea
8,389,885 B2 * 3/2013 Inamoto ..... H01H 13/85 200/513

(56) References Cited

U.S. PATENT DOCUMENTS 8,404,990 B2 3/2013 Lutgring et al.
8,451,146 B2 3/2013 Mahowald et al.
8,431,849 B2 4/2013 Chen
8,436,265 B2 5/2013 Koike et al.
8,462,514 B2 6/2013 Myers et al.
8,500,348 B2 8/2013 Dumont et al.
8,502,094 B2 8/2013 Chen
8,542,194 B2 9/2013 Akens et al.
8,548,528 B2 10/2013 Kim et al.
8,564,544 B2 10/2013 Jobs et al.
8,569,639 B2 10/2013 Strittmatter
8,575,632 B2 11/2013 Kuramoto et al.
8,581,127 B2 11/2013 Jhuang et al.
8,592,699 B2 11/2013 Kessler et al.
8,592,702 B2 11/2013 Tsai
8,592,703 B2 11/2013 Johnson et al.
8,604,370 B2 12/2013 Chao
8,629,362 B1 1/2014 Knighton et al.
8,642,904 B2 2/2014 Chiba et al.
8,651,720 B2 2/2014 Sherman et al.
8,659,882 B2 2/2014 Liang et al.
8,731,618 B2 5/2014 Jarvis et al.
8,748,767 B2 6/2014 Ozias et al.
8,759,705 B2 6/2014 Funakoshi et al.
8,760,405 B2 6/2014 Nam
8,786,548 B2 7/2014 Oh et al.
8,791,378 B2 7/2014 Lan
8,835,784 B2 9/2014 Hirota
8,847,090 B2 9/2014 Ozaki
8,847,711 B2 9/2014 Yang et al.
8,853,580 B2 10/2014 Chen
8,854,312 B2 10/2014 Meierling
8,870,477 B2 10/2014 Merminod et al.
8,884,174 B2 11/2014 Chou et al.
8,921,473 B1 12/2014 Hyman
8,922,476 B2 12/2014 Stewart et al.
8,943,427 B2 1/2015 Heo et al.
8,976,117 B2 3/2015 Krahenbuhl et al.
8,994,641 B2 3/2015 Stewart et al.
9,007,297 B2 4/2015 Stewart et al.
9,012,795 B2 4/2015 Niu et al.
9,024,214 B2 5/2015 Niu et al.
9,029,723 B2 5/2015 Pegg
9,063,627 B2 6/2015 Yairi et al.
9,064,642 B2 6/2015 Welch et al.
9,086,733 B2 7/2015 Pance
9,087,663 B2 7/2015 Los
9,093,229 B2 7/2015 Leong et al.
9,213,416 B2 12/2015 Chen
9,223,352 B2 12/2015 Smith et al.
9,234,486 B2 1/2016 Das et al.
9,235,236 B2 1/2016 Nam
9,274,654 B2 3/2016 Slobodin et al.
9,275,810 B2 3/2016 Pance et al.
9,300,033 B2 3/2016 Han et al.
9,305,496 B2 4/2016 Kimura
9,405,369 B2 8/2016 Modarres et al.
9,412,533 B2 * 8/2016 Hendren ..... H01H 13/14
9,443,672 B2 9/2016 Martisauskas
9,448,628 B2 9/2016 Tan et al.
9,448,631 B2 9/2016 Winter et al.
9,449,772 B2 9/2016 Leong et al.
9,471,185 B2 10/2016 Guard
9,477,382 B2 10/2016 Hicks et al.
9,502,193 B2 11/2016 Niu et al.
9,612,674 B2 4/2017 Degner et al.
9,640,347 B2 5/2017 Kwan et al.
9,715,978 B2 * 7/2017 Hendren ..... H01H 13/85
9,734,965 B2 8/2017 Martinez et al.
9,793,066 B1 10/2017 Brock et al.
2002/0079211 A1 6/2002 Katayama et al.
2002/0093436 A1 7/2002 Lien
2002/0113770 A1 8/2002 Jacobson et al.
2002/0149835 A1 10/2002 Kanbe
2003/0169232 A1 9/2003 Ito
2004/0004559 A1 1/2004 Rast
2004/0225965 A1 11/2004 Garside et al.
2005/0035950 A1 2/2005 Daniels
2005/0253801 A1 11/2005 Kobayashi
2006/0011458 A1 1/2006 Purcocks
2006/0020469 A1 1/2006 Rast
2006/0120790 A1 6/2006 Chang
2006/0181511 A1 8/2006 Woolley
2006/0243987 A1 11/2006 Lai
2007/0200823 A1 8/2007 Bytheway et al.
2007/0285393 A1 12/2007 Ishakov
2008/0131184 A1 6/2008 Brown et al.
2008/0136782 A1 6/2008 Mundt et al.
2008/0251370 A1 10/2008 Aoki
2009/0046053 A1 2/2009 Shigehiro et al.
2009/0103964 A1 4/2009 Takagi et al.
2009/0128496 A1 5/2009 Huang
2009/0262085 A1 10/2009 Wassingbo et al.
2009/0267892 A1 10/2009 Faubert
2010/0045705 A1 2/2010 Vertegaal et al.
2010/0066568 A1 3/2010 Lee
2010/0109921 A1 5/2010 Annerfors
2010/0156796 A1 6/2010 Kim et al.
2010/0253630 A1 10/2010 Homma et al.
2011/0032127 A1 2/2011 Roush
2011/0056817 A1 3/2011 Wu
2011/0056836 A1 3/2011 Tatebe et al.
2011/0205179 A1 8/2011 Braun
2011/0261031 A1 10/2011 Muto
2011/0267272 A1 11/2011 Meyer et al.
2011/0284355 A1 11/2011 Yang
2012/0012446 A1 1/2012 Hwa
2012/0032972 A1 2/2012 Hwang
2012/0090973 A1 4/2012 Liu
2012/0098751 A1 4/2012 Liu
2012/0286701 A1 11/2012 Yang et al.
2012/0298496 A1 11/2012 Zhang
2012/0313856 A1 12/2012 Hsieh
2013/0043115 A1 2/2013 Yang et al.
2013/0093500 A1 4/2013 Bruwer
2013/0093733 A1 4/2013 Yoshida
2013/0100030 A1 4/2013 Los et al.
2013/0120265 A1 5/2013 Horii et al.
2013/0161170 A1 6/2013 Fan et al.
2013/0215079 A1 8/2013 Johnson et al.
2013/0242601 A1 9/2013 Kloeppel et al.
2013/0270090 A1 10/2013 Lee
2014/0015777 A1 1/2014 Park et al.
2014/0027259 A1 1/2014 Kawana et al.
2014/0071654 A1 3/2014 Chien
2014/0082490 A1 3/2014 Jung et al.
2014/0090967 A1 4/2014 Inagaki
2014/0098042 A1 4/2014 Kuo et al.
2014/0118264 A1 5/2014 Leong et al.
2014/0151211 A1 6/2014 Zhang
2014/0184496 A1 7/2014 Gribetz et al.
2014/0191973 A1 7/2014 Zellers et al.
2014/0218851 A1 8/2014 Klein et al.
2014/0252881 A1 9/2014 Dinh et al.
2014/0291133 A1 10/2014 Fu et al.
2014/0346025 A1 * 11/2014 Hendren ..... H01H 13/14
200/513
2014/0375141 A1 12/2014 Nakajima
2015/0016038 A1 1/2015 Niu et al.
2015/0083561 A1 3/2015 Han et al.
2015/0090571 A1 4/2015 Leong et al.
2015/0270073 A1 9/2015 Yarak, III et al.
2015/0277559 A1 10/2015 Vescovi et al.
2015/0287553 A1 10/2015 Welch et al.
2015/0309538 A1 10/2015 Zhang
2015/0332874 A1 11/2015 Brock et al.
2015/0348726 A1 12/2015 Hendren
2015/0370339 A1 12/2015 Ligtenberg et al.
2015/0378391 A1 12/2015 Huitema et al.
2016/0049266 A1 2/2016 Stringer et al.
2016/0093452 A1 3/2016 Zercoe et al.
2016/0172129 A1 6/2016 Zercoe et al.
2016/0189890 A1 6/2016 Leong et al.
2016/0189891 A1 6/2016 Zercoe et al.

(56) References Cited

U.S. PATENT DOCUMENTS

| | | | |
|---|---|---|---|
| 2016/0259375 | A1 | 9/2016 | Andre et al. |
| 2016/0329166 | A1 | 11/2016 | Hou et al. |
| 2016/0336124 | A1 | 11/2016 | Leong et al. |
| 2016/0336127 | A1 | 11/2016 | Leong et al. |
| 2016/0336128 | A1 | 11/2016 | Leong et al. |
| 2016/0351360 | A1 | 12/2016 | Knopf et al. |
| 2016/0365204 | A1 | 12/2016 | Cao et al. |
| 2016/0378234 | A1 | 12/2016 | Ligtenberg et al. |
| 2016/0379775 | A1 | 12/2016 | Leong et al. |
| 2017/0004937 | A1 | 1/2017 | Leong et al. |
| 2017/0004939 | A1 | 1/2017 | Kwan et al. |
| 2017/0011869 | A1 | 1/2017 | Knopf et al. |
| 2017/0090106 | A1 | 3/2017 | Cao et al. |
| 2017/0301487 | A1 | 10/2017 | Leong et al. |
| 2017/0315624 | A1 | 11/2017 | Leong et al. |
| 2018/0029339 | A1 | 2/2018 | Liu et al. |
| 2018/0040441 | A1 | 2/2018 | Wu et al. |
| 2018/0074694 | A1 | 3/2018 | Lehmann et al. |

FOREIGN PATENT DOCUMENTS

| | | |
|---|---|---|
| CN | 1533128 | 9/2004 |
| CN | 1542497 | 11/2004 |
| CN | 2672832 | 1/2005 |
| CN | 1624842 | 6/2005 |
| CN | 1812030 | 8/2006 |
| CN | 1838036 | 9/2006 |
| CN | 1855332 | 11/2006 |
| CN | 101051569 | 10/2007 |
| CN | 200961844 | 10/2007 |
| CN | 200986871 | 12/2007 |
| CN | 101146137 | 3/2008 |
| CN | 201054315 | 4/2008 |
| CN | 201084602 | 7/2008 |
| CN | 201123174 | 9/2008 |
| CN | 201149829 | 11/2008 |
| CN | 101315841 | 12/2008 |
| CN | 201210457 | 3/2009 |
| CN | 101438228 | 5/2009 |
| CN | 101465226 | 6/2009 |
| CN | 101494130 | 7/2009 |
| CN | 101502082 | 8/2009 |
| CN | 201298481 | 8/2009 |
| CN | 101546667 | 9/2009 |
| CN | 101572195 | 11/2009 |
| CN | 101800281 | 8/2010 |
| CN | 101807482 | 8/2010 |
| CN | 101868773 | 10/2010 |
| CN | 201655616 | 11/2010 |
| CN | 102110542 | 6/2011 |
| CN | 102119430 | 7/2011 |
| CN | 201904256 | 7/2011 |
| CN | 102163084 | 8/2011 |
| CN | 201927524 | 8/2011 |
| CN | 201945951 | 8/2011 |
| CN | 201945952 | 8/2011 |
| CN | 201956238 | 8/2011 |
| CN | 102197452 | 9/2011 |
| CN | 202008941 | 10/2011 |
| CN | 202040690 | 11/2011 |
| CN | 102280292 | 12/2011 |
| CN | 102338348 | 2/2012 |
| CN | 102375550 | 3/2012 |
| CN | 202205161 | 4/2012 |
| CN | 102496509 | 6/2012 |
| CN | 10269527 | 8/2012 |
| CN | 102622089 | 8/2012 |
| CN | 102629526 | 8/2012 |
| CN | 202372927 | 8/2012 |
| CN | 102679239 | 9/2012 |
| CN | 102683072 | 9/2012 |
| CN | 202434387 | 9/2012 |
| CN | 202523007 | 11/2012 |
| CN | 102832068 | 12/2012 |
| CN | 102955573 | 3/2013 |
| CN | 102956386 | 3/2013 |
| CN | 102969183 | 3/2013 |
| CN | 103000417 | 3/2013 |
| CN | 103165327 | 6/2013 |
| CN | 103180979 | 6/2013 |
| CN | 203012648 | 6/2013 |
| CN | 203135988 | 8/2013 |
| CN | 103377841 | 10/2013 |
| CN | 103489986 | 1/2014 |
| CN | 203414880 | 1/2014 |
| CN | 103681056 | 3/2014 |
| CN | 103699181 | 4/2014 |
| CN | 203520312 | 4/2014 |
| CN | 203588895 | 5/2014 |
| CN | 103839715 | 6/2014 |
| CN | 103839720 | 6/2014 |
| CN | 103839722 | 6/2014 |
| CN | 103903891 | 7/2014 |
| CN | 103956290 | 7/2014 |
| CN | 203733685 | 7/2014 |
| CN | 104021968 | 9/2014 |
| CN | 204102769 | 1/2015 |
| CN | 204117915 | 1/2015 |
| CN | 104517769 | 4/2015 |
| CN | 204632641 | 9/2015 |
| CN | 105097341 | 11/2015 |
| DE | 2530176 | 1/1977 |
| DE | 3002772 | 7/1981 |
| DE | 29704100 | 4/1997 |
| DE | 202008001970 | 8/2008 |
| EP | 0441993 | 8/1991 |
| EP | 1835272 | 9/2007 |
| EP | 1928008 | 6/2008 |
| EP | 2202606 | 6/2010 |
| EP | 2426688 | 3/2012 |
| EP | 2439760 | 4/2012 |
| EP | 2463798 | 6/2012 |
| EP | 2664979 | 11/2013 |
| FR | 2147420 | 3/1973 |
| FR | 2911000 | 7/2008 |
| FR | 2950193 | 3/2011 |
| GB | 1361459 | 7/1974 |
| JP | S50115562 | 9/1975 |
| JP | S60055477 | 3/1985 |
| JP | S61172422 | 10/1986 |
| JP | S62072429 | 4/1987 |
| JP | S63182024 | 11/1988 |
| JP | H0422024 | 4/1992 |
| JP | H0520963 | 1/1993 |
| JP | H0524512 | 8/1993 |
| JP | H05342944 | 12/1993 |
| JP | H09204148 | 8/1997 |
| JP | H10312726 | 11/1998 |
| JP | H11194882 | 7/1999 |
| JP | 2000010709 | 1/2000 |
| JP | 2000057871 | 2/2000 |
| JP | 2000339097 | 12/2000 |
| JP | 2001100889 | 4/2001 |
| JP | 2003114751 | 9/2001 |
| JP | 2002260478 | 9/2002 |
| JP | 2002298689 | 10/2002 |
| JP | 2003522998 | 7/2003 |
| JP | 2005108041 | 4/2005 |
| JP | 2006164929 | 6/2006 |
| JP | 2006185906 | 7/2006 |
| JP | 2006521664 | 9/2006 |
| JP | 2006269439 | 10/2006 |
| JP | 2006277013 | 10/2006 |
| JP | 2006344609 | 12/2006 |
| JP | 2007115633 | 5/2007 |
| JP | 2007514247 | 5/2007 |
| JP | 2007156983 | 6/2007 |
| JP | 2008021428 | 1/2008 |
| JP | 2008041431 | 2/2008 |
| JP | 2008100129 | 5/2008 |
| JP | 2008191850 | 8/2008 |
| JP | 2008533559 | 8/2008 |
| JP | 2008293922 | 12/2008 |
| JP | 2009099503 | 5/2009 |

(56) References Cited

FOREIGN PATENT DOCUMENTS

| | | |
|---|---|---|
| JP | 2009181894 | 8/2009 |
| JP | 2010061956 | 3/2010 |
| JP | 2010244088 | 10/2010 |
| JP | 2010244302 | 10/2010 |
| JP | 2011018484 | 1/2011 |
| JP | 2011065126 | 3/2011 |
| JP | 2011150804 | 8/2011 |
| JP | 2011165630 | 8/2011 |
| JP | 2011524066 | 8/2011 |
| JP | 2011187297 | 9/2011 |
| JP | 2012022473 | 2/2012 |
| JP | 2012043705 | 3/2012 |
| JP | 2012063630 | 3/2012 |
| JP | 2012098873 | 5/2012 |
| JP | 2012134064 | 7/2012 |
| JP | 2012186067 | 9/2012 |
| JP | 2012230256 | 11/2012 |
| JP | 2014017179 | 1/2014 |
| JP | 2014026807 | 2/2014 |
| JP | 2014216190 | 11/2014 |
| JP | 2014220039 | 11/2014 |
| JP | 2016053778 | 4/2016 |
| KR | 1019990007394 | 1/1999 |
| KR | 1020020001668 | 1/2002 |
| KR | 100454203 | 10/2004 |
| KR | 1020060083032 | 7/2006 |
| KR | 1020080064116 | 7/2008 |
| KR | 1020080066164 | 7/2008 |
| KR | 2020110006385 | 6/2011 |
| KR | 1020120062797 | 6/2012 |
| KR | 1020130040131 | 4/2013 |
| KR | 20150024201 | 3/2015 |
| TW | 200703396 | 1/2007 |
| TW | M334397 | 6/2008 |
| TW | 201108284 | 3/2011 |
| TW | 201108286 | 3/2011 |
| TW | M407429 | 7/2011 |
| TW | 201246251 | 11/2012 |
| TW | 201403646 | 1/2014 |
| WO | WO9744946 | 11/1997 |
| WO | WO2005/057320 | 6/2005 |
| WO | WO2006/022313 | 3/2006 |
| WO | WO2007/049253 | 5/2007 |
| WO | WO2008/045833 | 4/2008 |
| WO | WO2009/005026 | 1/2009 |
| WO | WO2012/011282 | 1/2012 |
| WO | WO2012/027978 | 3/2012 |
| WO | WO2013/096478 | 6/2013 |
| WO | WO2014175446 | 10/2014 |

OTHER PUBLICATIONS

U.S. Appl. No. 15/640,249, filed Jun. 30, 2017, pending.
U.S. Appl. No. 15/649,840, filed Jul. 14, 2017, pending.
U.S. Appl. No. 15/687,297, filed Aug. 25, 2017, pending.
U.S. Appl. No. 15/692,810, filed Aug. 31, 2017, pending.
U.S. Appl. No. 15/725,125, filed Oct. 4, 2017, pending.
Elekson, "Reliable and Tested Wearable Electronics Embedment Solutions," http://www.wearable.technology/our-technologies, 3 pages, at least as early as Jan. 6, 2016.

* cited by examiner

900

LOW TRAVEL SWITCH ASSEMBLY

CROSS-REFERENCE TO RELATED APPLICATION

This application is a continuation patent application of U.S. patent application Ser. No. 14/287,915, filed May 27, 2014 and titled "Low Travel Switch Assembly," which is a nonprovisional patent application of and claims the benefit of U.S. Provisional Patent Application No. 61/827,708, filed May 27, 2013 and titled "Low Travel Switch Assembly," the disclosures of which are hereby incorporated herein in their entireties.

FIELD OF THE INVENTION

Embodiments described herein may relate generally to a switch for an input device, and may more specifically relate to a low travel switch assembly for a keyboard or other input device.

BACKGROUND

Many electronic devices (e.g., desktop computers, laptop computers, mobile devices, and the like) include a keyboard as one of its input devices. There are several types of keyboards that are typically included in electronic devices. These types are mainly differentiated by the switch technology that they employ. One of the most common keyboard types is the dome-switch keyboard. A dome-switch keyboard includes at least a key cap, a layered electrical membrane, and an elastic dome disposed between the key cap and the layered electrical membrane. When the key cap is depressed from its original position, an uppermost portion of the elastic dome moves or displaces downward (from its original position) and contacts the layered electrical membrane to cause a switching operation or event. When the key cap is subsequently released, the uppermost portion of the elastic dome returns to its original position, and forces the key cap to also move back to its original position.

In addition to facilitating a switching event, a typical elastic dome also provides tactile feedback to a user depressing the key cap. A typical elastic dome provides this tactile feedback by behaving in a certain manner (e.g., by changing shape, buckling, unbuckling, etc.) when it is depressed and released over a range of distances. This behavior is typically characterized by a force-displacement curve that defines the amount of force required to move the key cap (while resting over the elastic dome) a certain distance from its natural position.

It is often desirable to make electronic devices and keyboards smaller. To accomplish this, some components of the device may need to be made smaller. Moreover, certain movable components of the device may also have less space to move, which may make it difficult for them to perform their intended functions. For example, a typical key cap is designed to move a certain maximum distance when it is depressed. The total distance from the key cap's natural (undepressed) position to its farthest (depressed) position is often referred to as the "travel" or "travel amount." When a device is made smaller, this travel may need to be smaller. However, a smaller travel requires a smaller or restricted range of movement of a corresponding elastic dome, which may interfere with the elastic dome's ability to operate according to its intended force-displacement characteristics and to provide suitable tactile feedback to a user.

SUMMARY OF THE DISCLOSURE

A low travel switch assembly and systems and methods for using the same are provided.

In some embodiments, a low travel dome is provided that includes a domed surface having upper and lower portions, and a set of tuning members integrated within the domed surface between the upper and lower portions. The tuning members may be operative to control a force-displacement curve characteristic of the low travel dome. Further, the domed surface may define the tuning members and at least one region separating the tuning members.

In some embodiments, a method for manufacturing a low travel dome by selectively removing a set of predefined portions of the dome-shaped surface to tune the dome-shaped surface to operate according to a predefined force-displacement curve characteristic.

In some embodiments, a switch assembly is provided that includes a key cap, a support structure residing under the key cap, a domed surface disposed beneath the key cap and having a set of openings formed thereon, and an electrical membrane situated below the domed surface and operative to trigger a switch event. The set of openings may be operative to maintain the switch assembly in position when the electrical membrane is not triggering the switch event, and control the switch assembly to behave according to a predefined force-displacement curve.

BRIEF DESCRIPTION OF THE DRAWINGS

The above and other aspects and advantages of the invention will become more apparent upon consideration of the following detailed description, taken in conjunction with accompanying drawings, in which like reference characters refer to like parts throughout, and in which.

DETAILED DESCRIPTION

A low travel switch assembly and systems and methods for using the same are described with reference to FIGS. 1-13.

Figure 1:
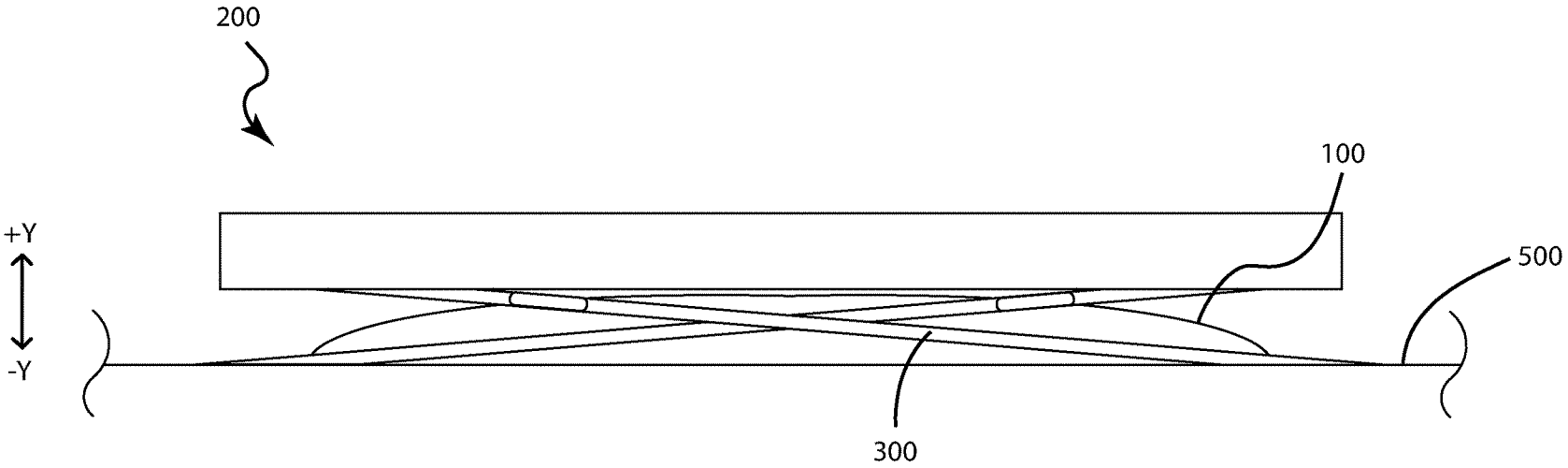
FIG. 1 is a cross-sectional view of a switch mechanism that includes a low travel dome, a key cap, a support structure, and a membrane, in accordance with at least one embodiment.

FIG. 1 is a cross-sectional view of a switch mechanism that includes a low travel dome 100, a key cap 200, a support structure 300, and a membrane 500. Low travel dome 100 may be composed of any suitable type of material (e.g., metal, rubber, etc.) and may be elastic. For example, when a force is applied to low travel dome 100, its elasticity may cause it to return to its original shape when the force is subsequently released. In some embodiments, low travel dome 100 may be one of a plurality of domes that may be a part of a dome pad or sheet (not shown). For example, low travel dome 100 may protrude from such a dome sheet in the +Y-direction. This dome sheet may reside beneath a set of key caps (e.g., key cap 200) of a keyboard (not shown) such that each dome of the dome pad may reside beneath a particular key cap of the keyboard.

As shown in FIG. 1, for example, low travel dome 100 may reside beneath key cap 200. Key cap 200 may be supported by support structure 300. Support structure 300 may be composed of any suitable material (e.g., plastic, metal, composite, and so on), and may provide mechanical stability to key cap 200. Support structure 300 may, for example, be a scissor mechanism or a butterfly mechanism that may contract and expand during depression and release of key cap 200, respectively. In some embodiments, rather than being a standalone scissor or butterfly mechanism, support structure 300 may be a part of an underside of key cap 200 that may press onto various portions of low travel dome 100. Regardless of the physical nature of support structure 300, key cap 200 may press onto low travel dome 100 to effect a switching operation or event via membrane 500 (described in more detail below with respect to FIGS. 5-8). Although not shown in FIG. 1, key cap 200 may also include a lower end portion that may be configured to contact an uppermost portion of low travel dome 100 during depression of key cap 200.

FIG. 1 may show key cap 200, low travel dome 100, support structure 300, and membrane 500 in an undepressed state (e.g., where each component may be in its respective natural position, prior to key cap 200 being depressed). Although FIG. 1 does not show key cap 200, low travel dome 100, support structure 300, and membrane 500 in a partially depressed or a fully depressed state, it should be appreciated that these components may occupy any of these states.

In addition to facilitating a switching event when a key cap is depressed, a dome of a dome-switch may also serve other purposes. As an example, the dome may cause the key cap to return to its natural state or position after the key cap is released from depression. As another example, the dome may provide tactical feedback to a user when the user depresses the key cap. The physical attributes (e.g., elasticity, size, shape, and the like) of the dome may determine the level of tactical feedback it provides. In particular, the physical attributes may define a relationship between the amount of force required to move the key cap (e.g., when the key cap rests over the dome) over a range of distances. This relationship may be expressed by a force-displacement curve, and the dome may operate according to this curve.

The amount of force required to move the key cap may vary depending on how far the key cap has moved from its natural position, and a user may experience the tactile feedback as a result of this variance. For example, the force required to move an uppermost portion of the dome from its natural or initial position to a first distance (e.g., right up to the point before the dome collapses or buckles) may be a force F1.

The force required to continue to move the uppermost portion past this first distance may be less than force F1. This is because the dome may buckle or collapse when the uppermost portion moves past the first distance, which may lessen the force required to continue to move the uppermost portion.

The force required to move the uppermost portion to a point when the dome is just completely buckled or collapsed may be a force F2. The force required to continue to move the uppermost portion until the key cap reaches its farthest or most depressed point may then increase. A user may thus experience a certain tactile feedback due to the force-displacement characteristics of the dome.

It should be appreciated that the tactile feedback can be quantified when the force-displacement characteristics of a dome are known. More particularly, the tactile feedback is a function of the ratio (e.g., click ratio) of the force required to move the uppermost portion of the dome from its natural position to a distance right before the dome begins to buckle or collapse (e.g., force F1) to the force required to move the uppermost portion from its natural position to a distance when the dome is just completely buckled or collapsed (e.g., force F2).

Because a dome's tactile feedback is tied to the force-displacement characteristics of the dome, it should also be appreciated that force-displacement characteristics of a dome can be determined when an optimal or suitable tactile feedback is predefined. For example, a dome may provide optimal tactile feedback when the click ratio is about 50%. This click ratio may be used to determine force-displacement characteristics (e.g., force F1 and force F2) required to provide the optimal tactile feedback. Accordingly, because the physical attributes of the dome correspond to the force-displacement characteristics, the dome may be specifically constructed in order to meet these characteristics.

As described above, it is often desirable to make electronic devices and keyboards smaller. To accomplish this, some components of a device may need to be made smaller. Moreover, certain movable components of the device may also have less space to move, which may make it difficult for them to perform their intended functions. For example, the travel of the key caps of a keyboard will have to be smaller. However, a smaller travel requires a smaller or restricted range of movement of a corresponding dome, which may interfere with the dome's ability to operate according to its intended force-displacement characteristics and to provide suitable tactile feedback to a user.

Since the physical attributes of the dome are associated with the dome's tactile feedback, they may be adjusted, modified, manipulated, or otherwise tuned to compensate for the smaller travel, while also providing the predefined tactile feedback.

Certain physical attributes of a dome may be adjusted, modified, manipulated, or otherwise tuned to compensate for a specified travel, while also providing predefined tactile feedback. That is, certain physical attributes of a dome may be tuned such that the dome operates according to predetermined force-displacement curve characteristics. In some embodiments, the height, thickness, and diameter of the dome may be tuned. In some embodiments, a surface of the dome may be adjusted or modified to tune the structural integrity of the surface.

Figure 2:
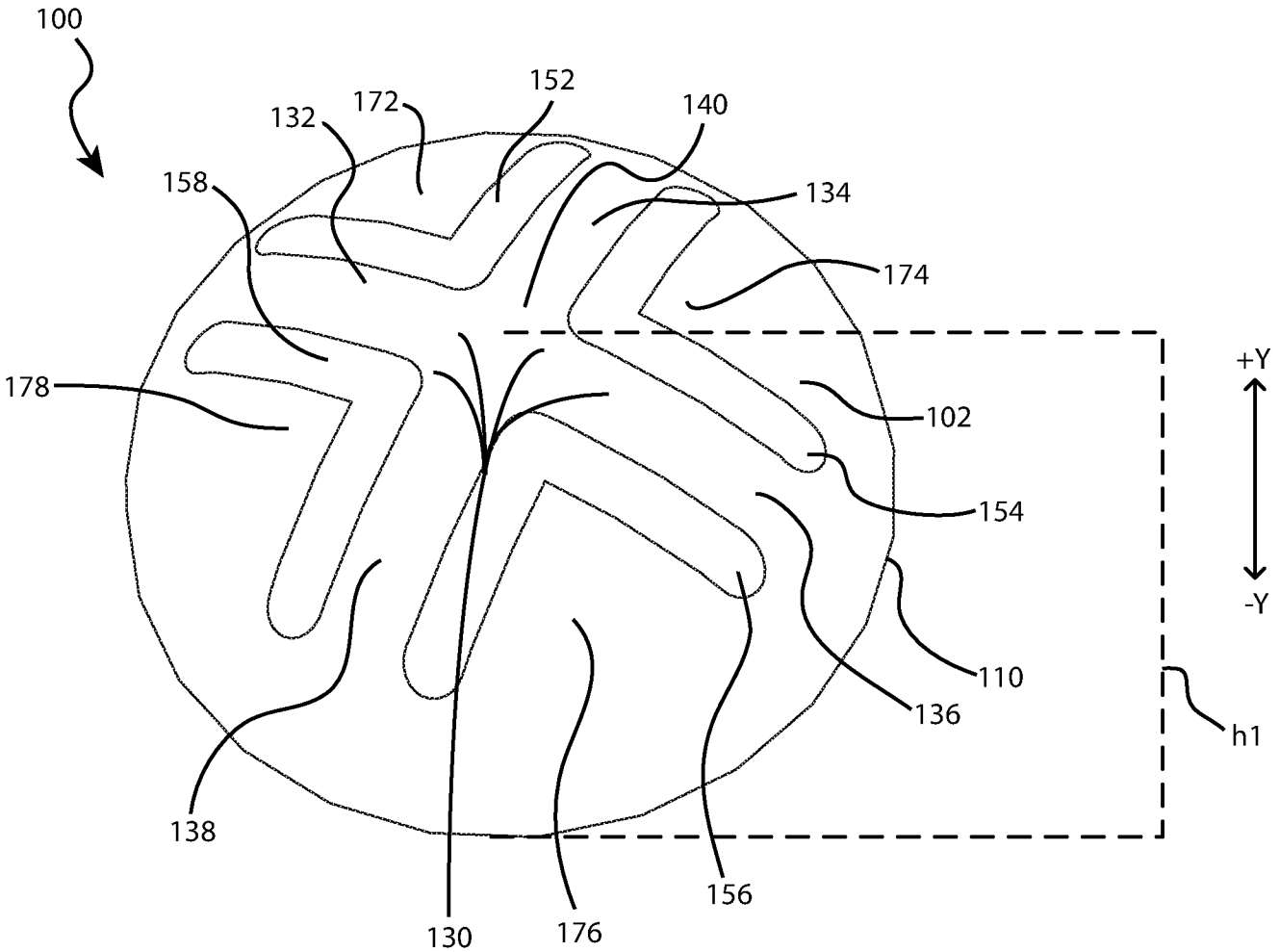
FIG. 2 is a perspective view of the low travel dome of FIG. 1, in accordance with at least one embodiment.
Figure 3:
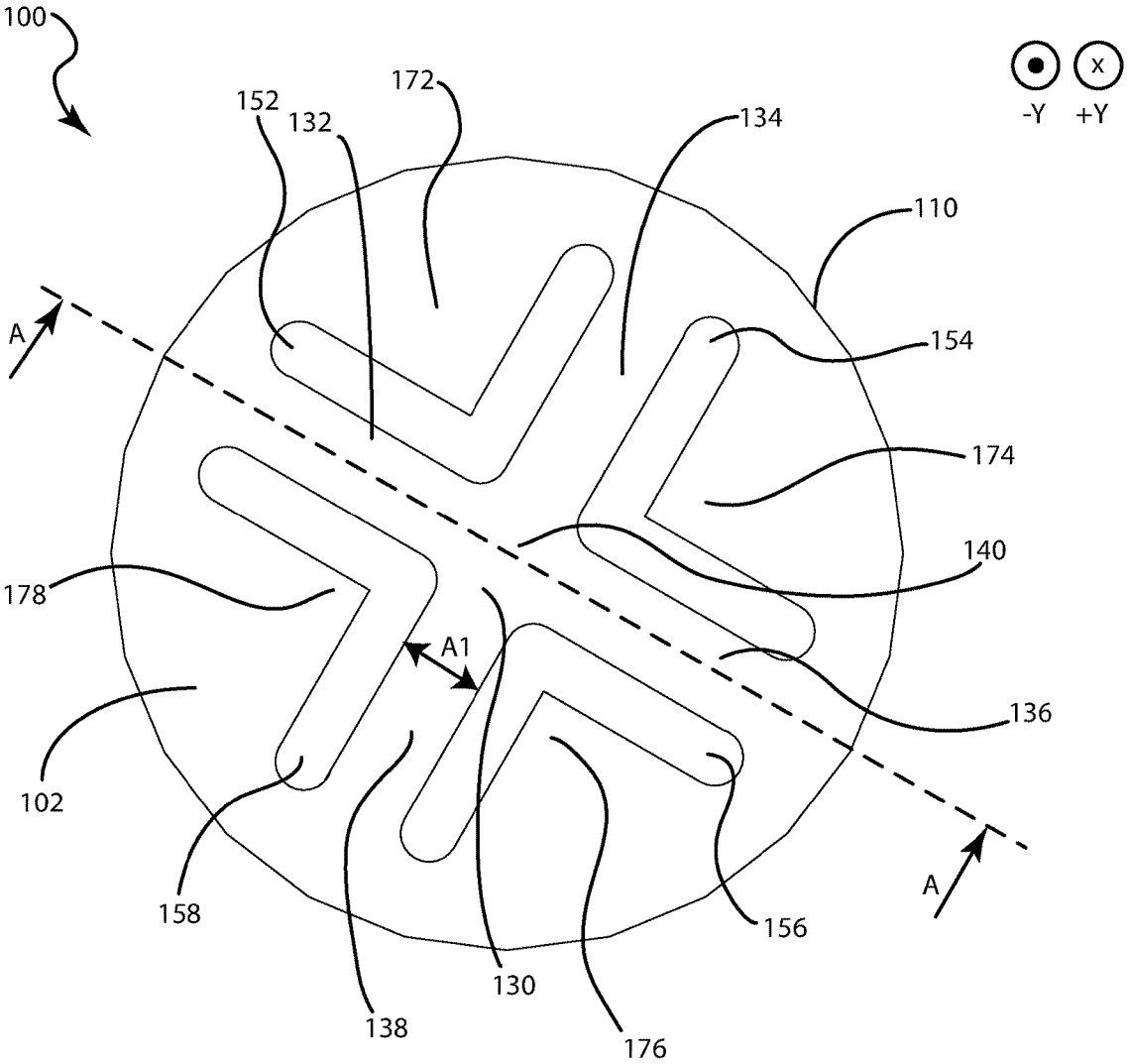
FIG. 3 is a top view of the low travel dome of FIG. 2, in accordance with at least one embodiment.

FIG. 2 is a perspective view of low travel dome 100. FIG. 3 is a top view of low travel dome 100. As shown in FIGS. 2 and 3, low travel dome 100 may include domed surface 102 having an upper portion 140 (e.g., that may include an uppermost portion of domed surface 102), a lower portion 110, and a set of tuning members 152, 154, 156, and 158 disposed between upper and lower portions 140 and 110. Domed surface 102 may have a hemispherical, semispherical, or convex profile, where upper portion 140 forms the top of the profile and lower portion 110 forms the base of the profile. Lower portion 110 can take any suitable shape such as, for example, a circular, elliptical, rectilinear, or another polygonal shape.

The physical attributes of low travel dome 100 may be tuned in any suitable manner. In some embodiments, tuning members 152, 154, 156, and 158 may be cutouts or openings of domed surface 102 that may be integrated or formed in domed surface 102. That is, predefined portions (e.g., of a predefined size and shape) of domed surface 102 may be removed in order to control or tune low travel dome 100 such that it operates according to predetermined force-displacement curve characteristics.

Tuning members 152, 154, 156, and 158 may be spaced from one another such that one or more portions of domed surface 102 may extend from lower portion 110 of domed surface 102 to uppermost portion 140 of domed surface 102. For example, tuning members 152, 154, 156, and 158 may be evenly spaced from one another such that wall or arm portions 132, 134, 136, and 138 of domed surface 102 may form a cross-shaped (or X-shaped) portion 130 that may span from portion 110 to uppermost portion 140.

As shown in FIG. 2, portions 172, 174, 176, and 178 of domed surface 102 may each be partially contiguous with some parts of cross-shaped portion 130, but may also be partially separated from other parts of cross-shaped portion 130 due to tuning members 152, 154, 156, and 158.

Although FIGS. 2 and 3 show only four tuning members 152, 154, 156, and 158, in some embodiments, low travel dome 100 may include more or fewer tuning members. In some embodiments, the shape of each one of tuning members 152, 154, 156, and 158 may be tuned such that low travel dome 100 may operate according to predetermined force-displacement curve characteristics. In particular, each one of tuning members 152, 154, 156, and 158 may have a particular shape. As shown in FIG. 3, for example, when viewing low travel dome 100 from the top, each one of tuning members 152, 154, 156, and 158 may appear to have an L-shape. In some embodiments, tuning members 152, 154, 156, and 158 may have a pie or wedge shape.

Generally, it should be appreciated that the dome 100 shown in FIGS. 2-3 defines a set of opposed beams. Each beam is defined by a pair of arm segments and is generally contiguous across a surface of the dome 100. For example, a first beam may be defined by arm portions 134 and 138 while a second arm is defined by arm portions 132 and 136. Thus, the beams cross one another at the top of the dome but are generally opposed to one another (e.g., extend in different directions). In the present embodiment, the beams are opposed by 90 degrees, but other embodiments may have beams that are opposed or offset by different angles. Likewise, more or fewer beams may be present or defined in various embodiments.

The beams may be configured to collapse or displace when a sufficient force is exerted on the dome. Thus, the beams may travel downward according to a particular force-displacement curve; modifying the size, shape, thickness and other physical characteristics may likewise modify the force-displacement curve. Thus, the beams may be tuned in a fashion to provide a downward motion at a first force and an upward motion or travel at a second force. Thus, the beams may snap downward when the force exerted on a keycap (and thus on the dome) exceeds a first threshold, and may be restored to an initial or default position when the exerted force is less than a second threshold. The first and second thresholds may be chosen such that the second threshold is less than the first threshold, thus providing hysteresis to the dome 100.

It should be appreciated that the force curve for the dome 100 may be adjusted not only by adjusting certain characteristics of the beams and/or arm portions 132, 134, 136, 138, but also by modifying the size and shape of the tuning members 152, 154, 156, 158. For example, the tuning members may be made larger or smaller, may have different areas and/or cross-sections, and the like. Such adjustments to the tuning members 152, 154, 156, 158 may also modify the force-displacement curve of the dome 100.

In some embodiments, each one of arm portions 132, 134, 136, and 138 of low travel dome 100 may be tuned such that low travel dome 100 may operate according to predetermined force-displacement curve characteristics. In particular, each one of arm portions 132, 134, 136, and 138 may be tuned to have a thickness a1 (e.g., as shown in FIG. 3) that may be less than a predefined thickness. For example, thickness a1 may be less than or equal to about 0.6 millimeters in some embodiments, but may be thicker or thinner in others.

In some embodiments, the hardness of the material of low travel dome 100 may tuned such that low travel dome 100 may operate according to predetermined force-displacement curve characteristics. In particular, the hardness of the material of low travel dome 100 may be tuned to be greater than a predefined hardness such that cross-shaped portion 130 may not buckle as easily as if the material were softer.

Although FIGS. 2 and 3 may show domed surface 102 having a cross-shaped portion 130, it should be appreciated that domed surface 102 may have a portion that may include any suitable number of arm portions. In some embodiments, rather than having four arm portions 132, 134, 136, 138, domed surface 102 may include more or fewer arm portions. In some embodiments, low travel dome 100 may be tuned such that it is operative to maintain key cap 200 and support structure 300 in their respective natural positions when key cap 200 is not undergoing a switch event (e.g., not being depressed). In these embodiments, low travel dome 100 may control key cap 200 (and support structure 300, if it is included) to operate according to predetermined force-displacement curve characteristics.

Regardless of how low travel dome 100 is tuned, when an external force is applied (for example, on or through key cap 200 of FIG. 1) to upper portion 140, cross-shaped portion 130 may move in the −Y-direction, and may cause arm portions 132, 134, 136, and 138 to change shape and buckle. As a result, an underside (e.g., directly opposite uppermost portion 140 of domed surface 102) may contact a portion of a membrane (e.g., membrane 500 of FIG. 1) of a keyboard when cross-shaped portion 130 moves a sufficient distance in the −Y-direction. In this manner, a switching operation or event may be triggered.

Figure 10:
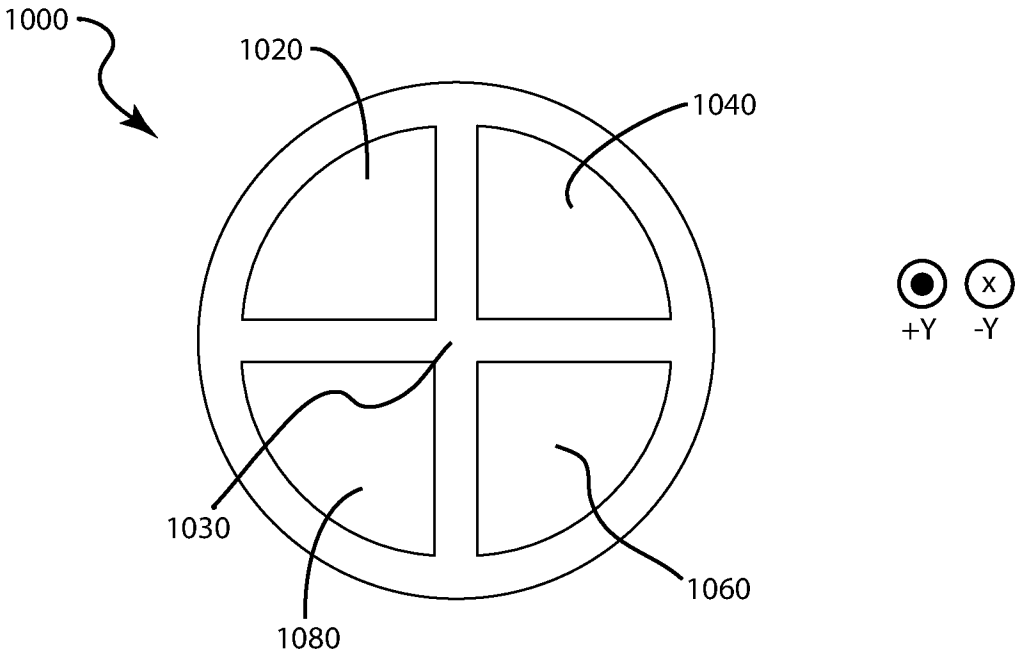
FIG. 10 is a top view of another low travel dome, in accordance with at least one embodiment.

FIG. 10 is a top view of an alternative low travel dome 1000 that may be similar to low travel dome 100, and that may be tuned to operate according to predetermined force-displacement curve characteristics. As shown in FIG. 10, low travel dome 1000 may include a cross-shaped portion 1030, and a set of tuning members 1020, 1040, 1060, and 1080. When viewing low travel dome 1000 from the top (e.g., as shown in FIG. 10), each one of tuning members 1020, 1040, 1060, and 1080 may appear to be pie-shaped.

Figure 11:
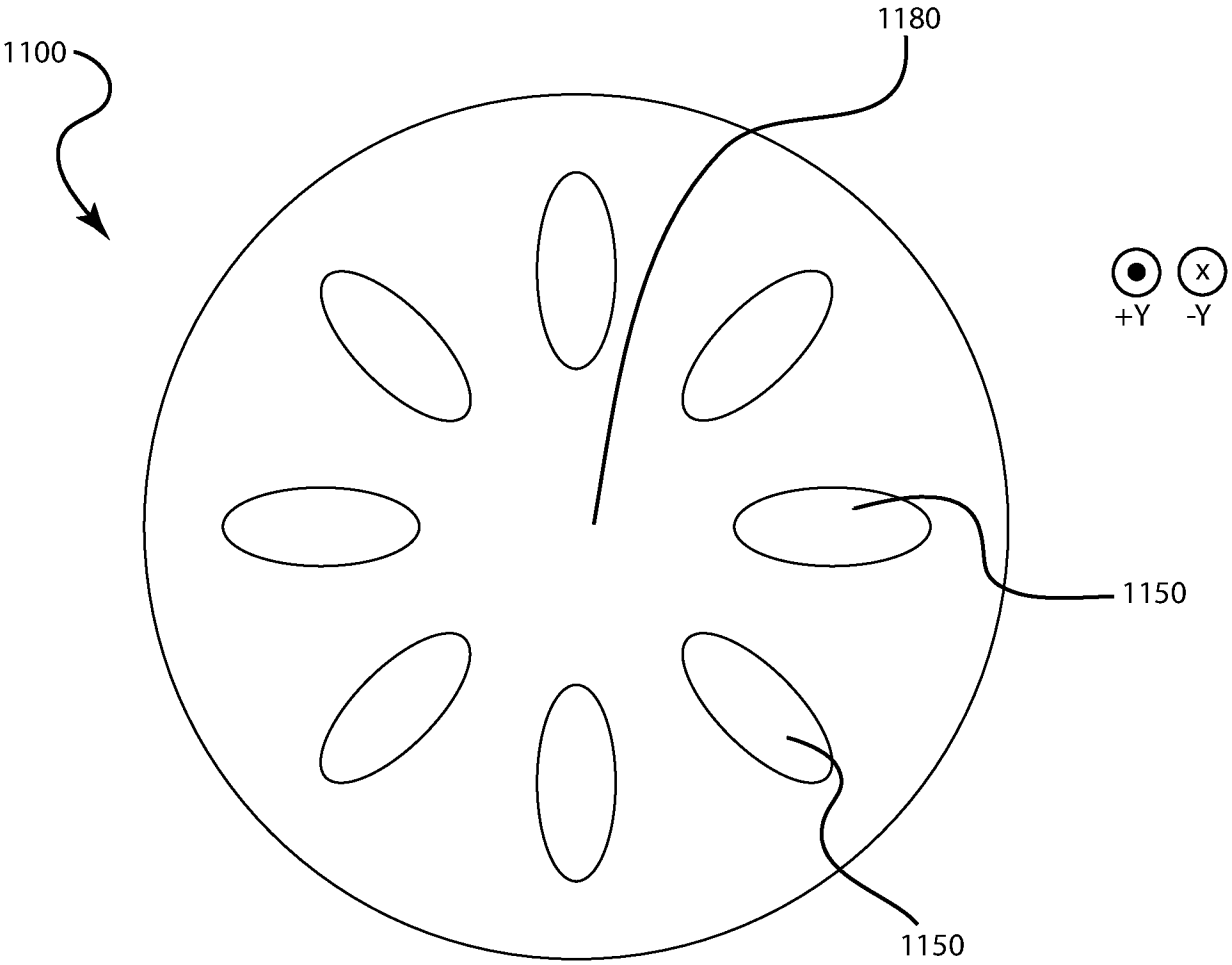
FIG. 11 is a top down view of yet another low travel dome, in accordance with at least one embodiment.

FIG. 11 is a top view of another alternative low travel dome 1100 that may be similar to low travel dome 100, and that may be tuned to operate according to predetermined force-displacement curve characteristics. As shown in FIG. 11, low travel dome 1100 may include a surface 1180, and a set of tuning members 1150. When viewing low travel dome 1100 from the top (e.g., as shown in FIG. 11), each one of tuning members 1150 may appear to have any suitable shape (e.g., elliptical, circular, rectangular, and the like).

Figure 4:
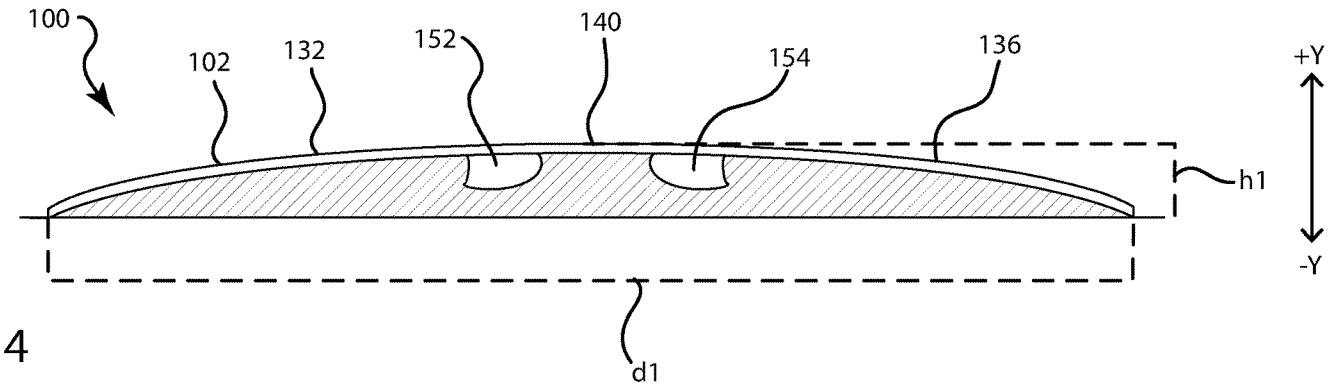
FIG. 4 is a cross-sectional view of the low travel dome of FIG. 3, taken from line A-A of FIG. 3, in accordance with at least one embodiment.

FIG. 4 is a cross-sectional view of low travel dome 100, taken from line A-A of FIG. 3. FIG. 4 is similar to FIG. 1, but does not show support structure 300. In some embodiments, support structure 300 may not be necessary, and a switching assembly may merely include key cap 200, low travel dome 100, and membrane 500. As shown in FIG. 4, arm portions 132 and 136 of cross-shaped portion 130 may form a contiguous arm portion that may span across domed surface 102.

Figure 5:
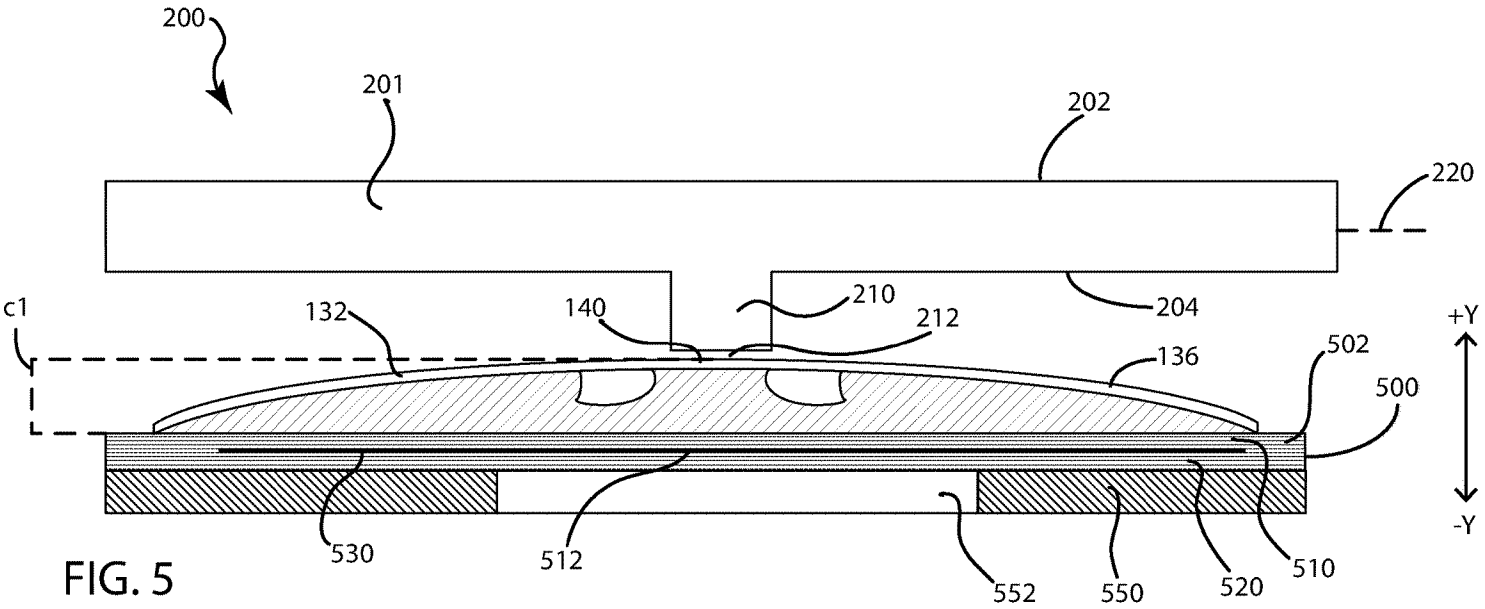
FIG. 5 is a cross-sectional view, similar to FIG. 4, of the low travel dome of FIG. 3, the low travel dome residing between the key cap and the membrane of FIG. 1 in a first state, in accordance with at least one embodiment.

FIG. 5 is a cross-sectional view, similar to FIG. 4, of low travel dome 100, with low travel dome 100 residing between key cap 200 and membrane 500 in a first state. Key cap 200, low travel dome 100, and membrane 500 may, for example, form one of the key switches or switch assemblies of a keyboard. As shown in FIG. 5, key cap 200 may include a body portion 201 and a contact portion 210. Body portion 201 may include a cap surface 202 and an underside 204, and contact portion 210 may include a contact surface 212. As shown in FIG. 5, key cap 200 may be in its natural position 220 (e.g., prior to cap surface 202 receiving any force (e.g., from a user)). Moreover, each one of low travel dome 100, and membrane 500 may be in their respective natural positions.

In some embodiments, membrane 500 may be a part of a printed circuit board ("PCB") that may interact with low travel dome 100. As described above with respect to FIG. 1, low travel dome 100 may be a component of a keyboard (not shown). In some embodiments, the keyboard may include a PCB and membrane that may provide key switching (e.g., when key cap 200 is depressed in the −Y-direction via an external force). Membrane 500 may include a top layer 510, a bottom layer 520, and a spacing 530 between top layer 510 and bottom layer 520. In some embodiments, membrane 500 may also include a support layer 550 that may include a through-hole 552 (e.g., a plated through-hole). Top and bottom layers 510 and 520 may reside above support layer 550. In some embodiments, top layer 510 and bottom layer 520 may each have a predefined thickness in the Y-direction, and spacing 530 may have a predefined height. Each one of top, bottom, and support layers 510, 520, and 550 may be composed of any suitable material (e.g., plastic, such as polyethylene terephthalate ("PET") polymer sheets, etc.). For example, each one of top and bottom layers 510 and 520 may be composed of PET polymer sheets that may each have a predefined thickness.

Top layer 510 may couple to or include a corresponding conductive pad (not shown), and bottom layer 520 may couple to or include a corresponding conductive pad (not shown). In some embodiments, each of these conductive pads may be in the form of a conductive gel. The gel-like nature of the conductive pads may provide improved tactile feedback to a user when, for example, the user depresses key cap 200. The conductive pad associated with top layer 510 may include corresponding conductive traces on an underside of top layer 510, and the conductive pad associated with bottom layer 520 may include conductive traces on an upper side of bottom layer 520. These conductive pads and corresponding conductive traces may be composed of any suitable material (e.g., metal, such as silver, or copper, conductive gels, nanowire, and no on).

As shown in FIG. 5, spacing 530 may allow top layer 510 to contact bottom layer 520 when, for example, low travel dome 100 buckles and cross-shaped portion 130 moves in the −Y-direction (e.g., due to an external force being applied to cap surface 202 of key cap 200). In particular, spacing 530 may allow the conductive pad associated with top layer 510 physical access to the conductive pad associated with bottom layer 520 such that their corresponding conductive traces may make contact with one another. This contact may then be detected by a processing unit (e.g., a chip of the electronic device or keyboard) (not shown), which may generate a code corresponding to key cap 200.

In some embodiments, key cap 200, low travel dome 100, and membrane 500 may be included in a surface-mountable package, which may facilitate assembly of, for example, an electronic device or keyboard, and may also provide reliability to the various components.

Although FIG. 5 shows a specific layered membrane that may be used to trigger a switch event, it should be appreciated that other mechanisms may also be used to trigger the switch event. For example, in some embodiments, low travel dome 100 may include a conductive material. In these embodiments, a separate conductive material may also reside beneath an underside of upper portion 140. When a keystroke occurs (e.g., when external force A is applied to key cap 200), the conductive material of low travel dome 100 may contact the separate conductive material, which may trigger the switch event.

Figure 6:
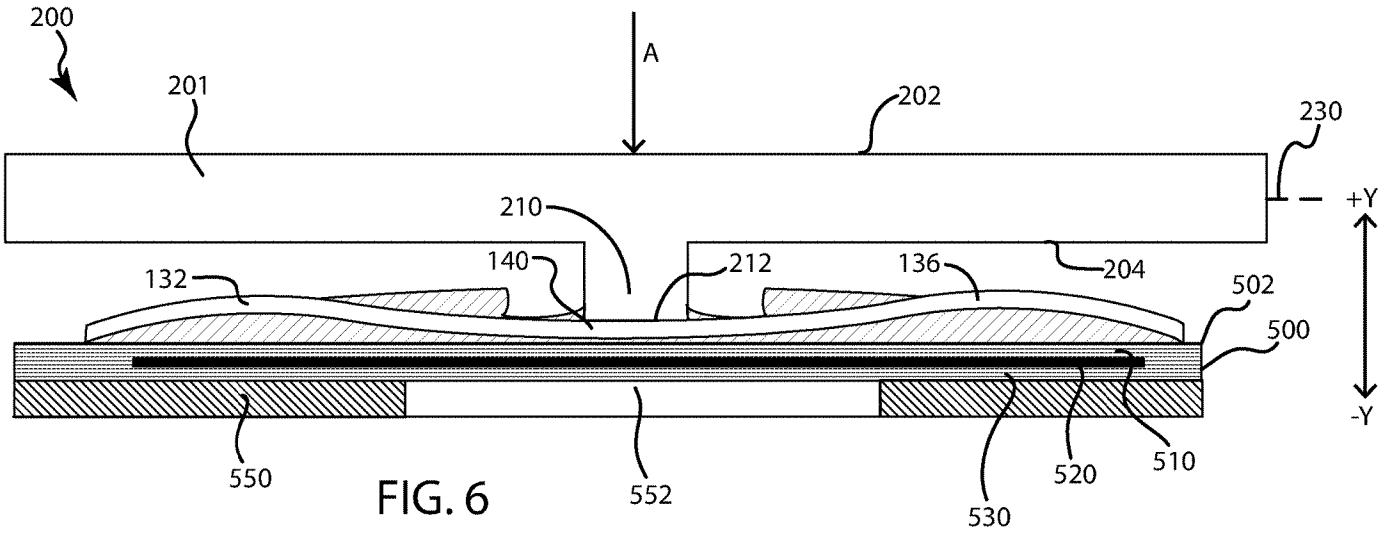
FIG. 6 is a cross-sectional view, similar to FIG. 5, of the low travel dome, the key cap, and the membrane of FIG. 5 in a second state, in accordance with at least one embodiment.
Figure 7:
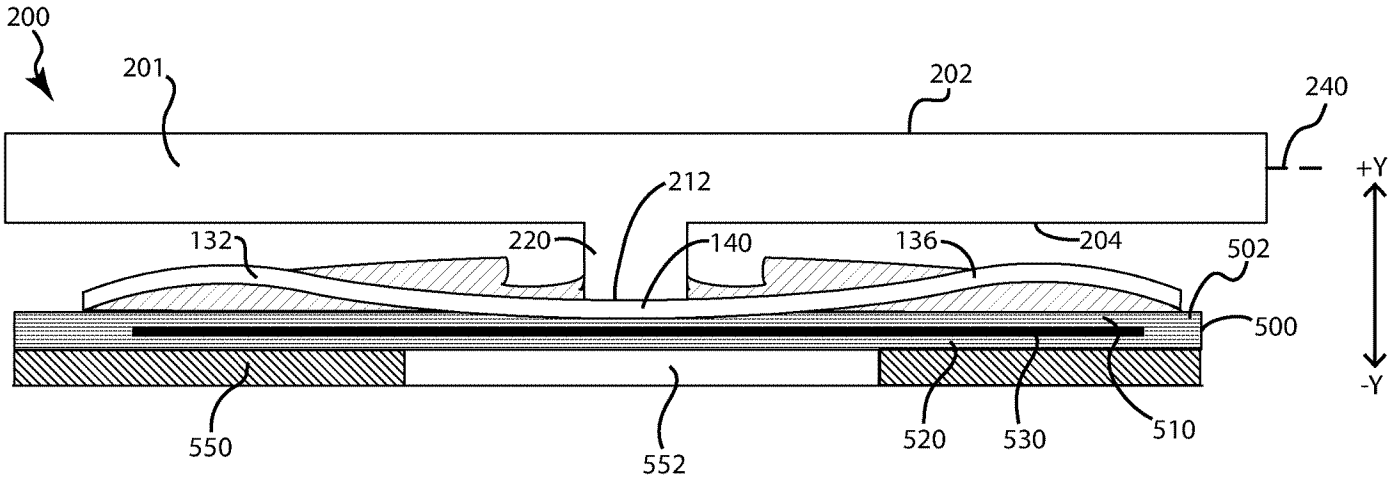
FIG. 7 is a cross-sectional view, similar to FIG. 5, of the low travel dome, the key cap, and the membrane of FIG. 5 in a third state, in accordance with at least one embodiment.
Figure 8:
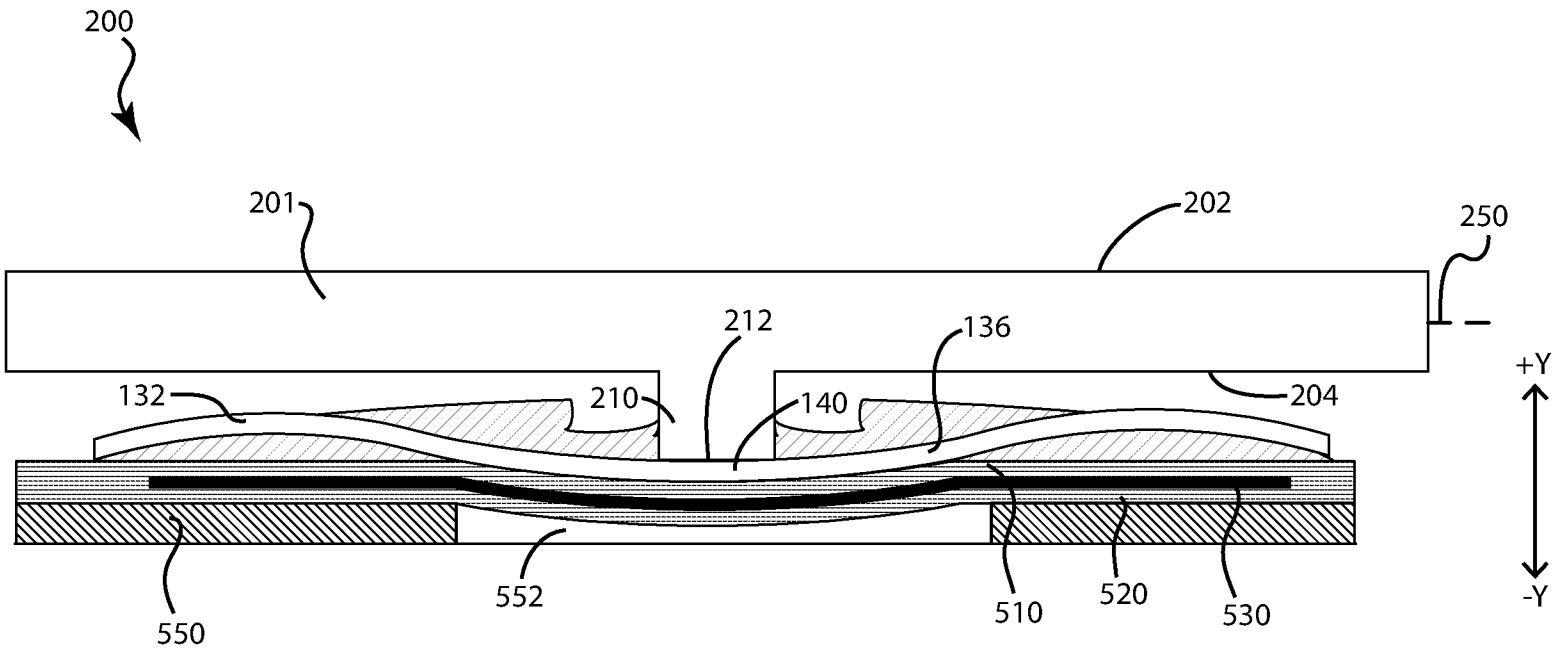
FIG. 8 is a cross-sectional view, similar to FIG. 5, of the low travel dome, the key cap, and the membrane of FIG. 5 in a fourth state, in accordance with at least one embodiment.
Figure 9:
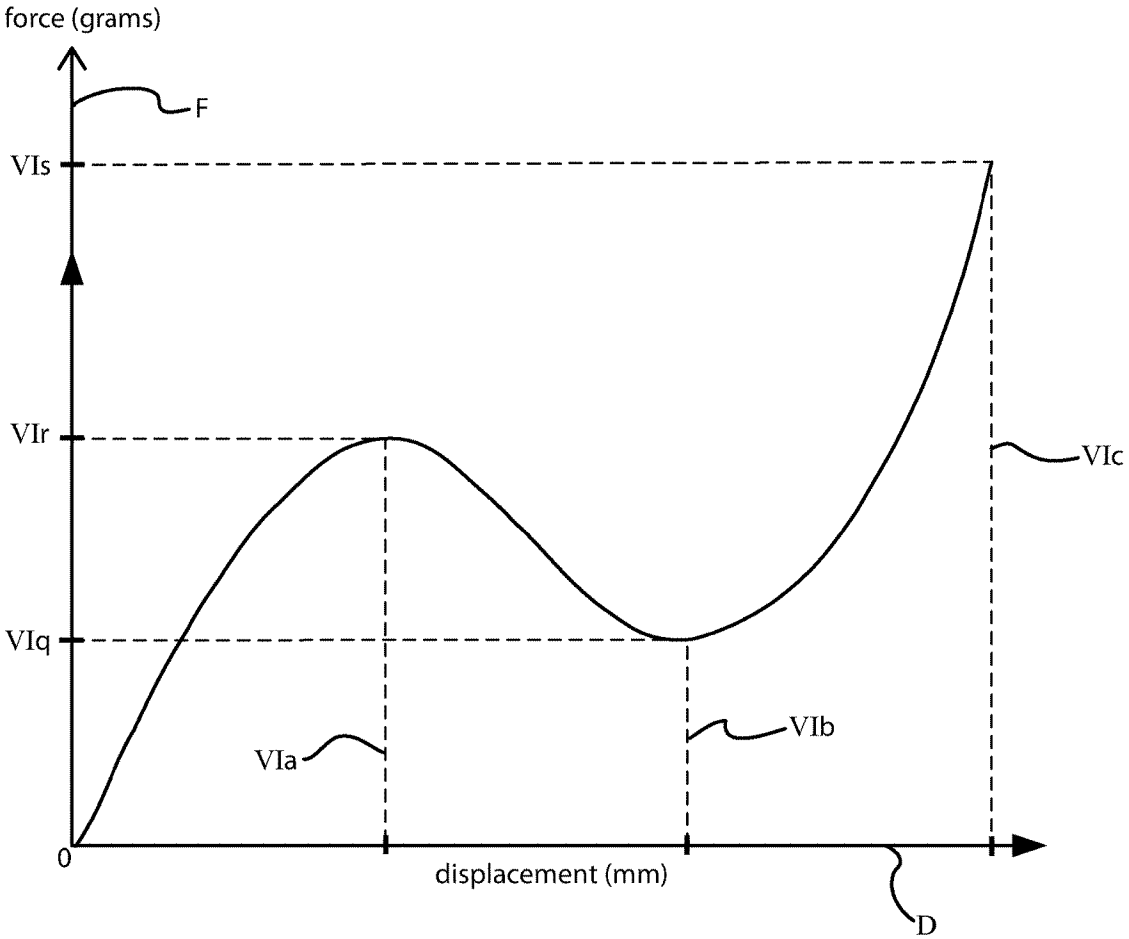
FIG. 9 shows a predefined force-displacement curve according to which the key cap and the low travel dome of FIGS. 5-8 may operate, in accordance with at least one embodiment.

As described above, low travel dome 100 may be tuned in any suitable manner such that low travel dome 100 (and thus, key cap 200) may operate according to predetermined force-displacement curve characteristics. FIGS. 6-8 are cross-sectional views, similar to FIG. 5, of low travel dome 100, key cap 200, and membrane 500 in second, third, and fourth states, respectively. FIG. 9 shows a predefined force-displacement curve 900 according to which key cap 200 and low travel dome 100 may operate. The F-axis may represent the force (in grams) that is applied to key cap 200, and the D-axis may represent the displacement of key cap 200 in response to the applied force.

The force required to depress key cap 200 from its natural position 220 (e.g., the position of key cap 200 prior to any force being applied thereto, as shown in FIG. 5) to a maximum displacement position 250 (e.g., as shown in FIG. 8) may vary. As shown in FIG. 9, for example, the force required to displace key cap 200 may gradually increase as key cap 200 displaces in the −Y-direction from natural position 220 (e.g., 0 millimeters) to a position 230 (e.g., VIa millimeters). This gradual increase in required force is at least partially due to the resistance of low travel dome 100 to change shape (e.g., the resistance of upper portion 140 to displace in the −Y-direction). The force required to displace key cap 200 to position 230 may be referred to as the operating or peak force.

When key cap 200 displaces to position 230 (e.g., VIa millimeters), low travel dome 100 may no longer be able to resist the pressure, and may begin to buckle (e.g., cross-shaped portion 130 may begin to buckle). The force that is subsequently required to displace key cap 200 from position 230 (e.g., VIa millimeters) to a position 240 (e.g., VIb millimeters) may gradually decrease.

When key cap 200 displaces to position 240 (e.g., VIb millimeters), an underside of upper portion 140 of low travel dome 100 may contact membrane 500 to cause or trigger a switch event or operation. In some embodiments, the underside may contact membrane 500 slightly prior to or slightly after key cap 200 displaces to position 240. When contact surface 107 contacts membrane 500, membrane 500 may provide a counter force in the +Y-direction, which may increase the force required to continue to displace key cap 200 beyond position 240. The force required to displace key cap 200 to position 240 may be referred to as the draw or return force.

When key cap 200 displaces to position 240, low travel dome 100 may also be complete in its buckling. In some embodiments, upper portion 140 may continue to displace in the −Y-direction, but cross-shaped portion 130 of low travel dome 100 may be substantially buckled. The force that is subsequently required to displace key cap 200 from position 240 (e.g., VIb millimeters) to position 250 (e.g., VIc millimeters) may gradually increase. Position 250 may be the maximum displacement position of key cap 200 (e.g., a bottom-out position). When the force (e.g., external force A) is removed from key cap 200, elastomeric dome 100 may then unbuckle and return to its natural position, and key cap may also return to natural position 220.

In some embodiments, the size or height of contact portion 210 may be defined to determine the maximum displacement position 250 or travel of key cap 200 in the −Y-direction. For example, the travel of key cap 200 may be defined to be about 0.75 millimeter, 1.0 millimeter, or 1.25 millimeters.

In addition to a cushioning effect provided by the gel-like conductive pads of top and bottom layers 510 and 520 to low travel dome 100 and key cap 200, in some embodiments, through-hole 552 may also provide a cushioning effect. As shown in FIG. 8, for example, when key cap 200 displaces to maximum displacement position 250 and low travel dome 100 completely buckles and presses onto top layer 510, bottom layer 520 may bend or otherwise interact with support layer 550 such that a portion of bottom layer 520 may enter into a void of through-hole 552. In this manner, key cap 200 may receive a cushioning effect, which may translate into improved tactile feedback for a user.

Figure 12:
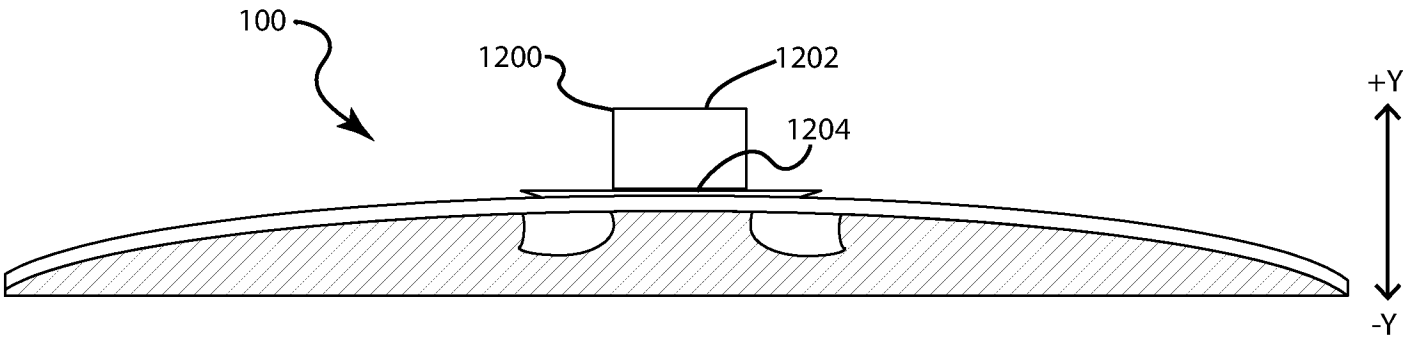
FIG. 12 is a cross-sectional view, similar to FIG. 4, of the low travel dome of FIG. 3 including a nub, in accordance with at least one embodiment.

In some embodiments, key cap 200 may or may not include contact portion 210. When key cap 200 does not include contact portion 210, for example, underside 204 of key cap 200 may not be sufficient to press onto upper portion 140 of cross-shaped portion 130. Thus, in these embodiments, low travel dome 100 may include a force concentrator nub that may contact underside 204 when a force is applied to cap surface 202 in the −Y-direction. FIG. 12 is a cross-sectional view, similar to FIG. 4, of low travel dome 100 including a nub 1200. As shown in FIG. 12, force concentrator nub 1200 may have a block shape having underside 1204 that may contact upper portion 140 of dome 100, and an upper side 1202 that may contact underside 204 of key cap 200. In this manner, when key cap 200 displaces in the −Y-direction due to an external force, underside 204 may press onto upper side 1202 and direct the external force onto upper portion 140.

Figure 13:
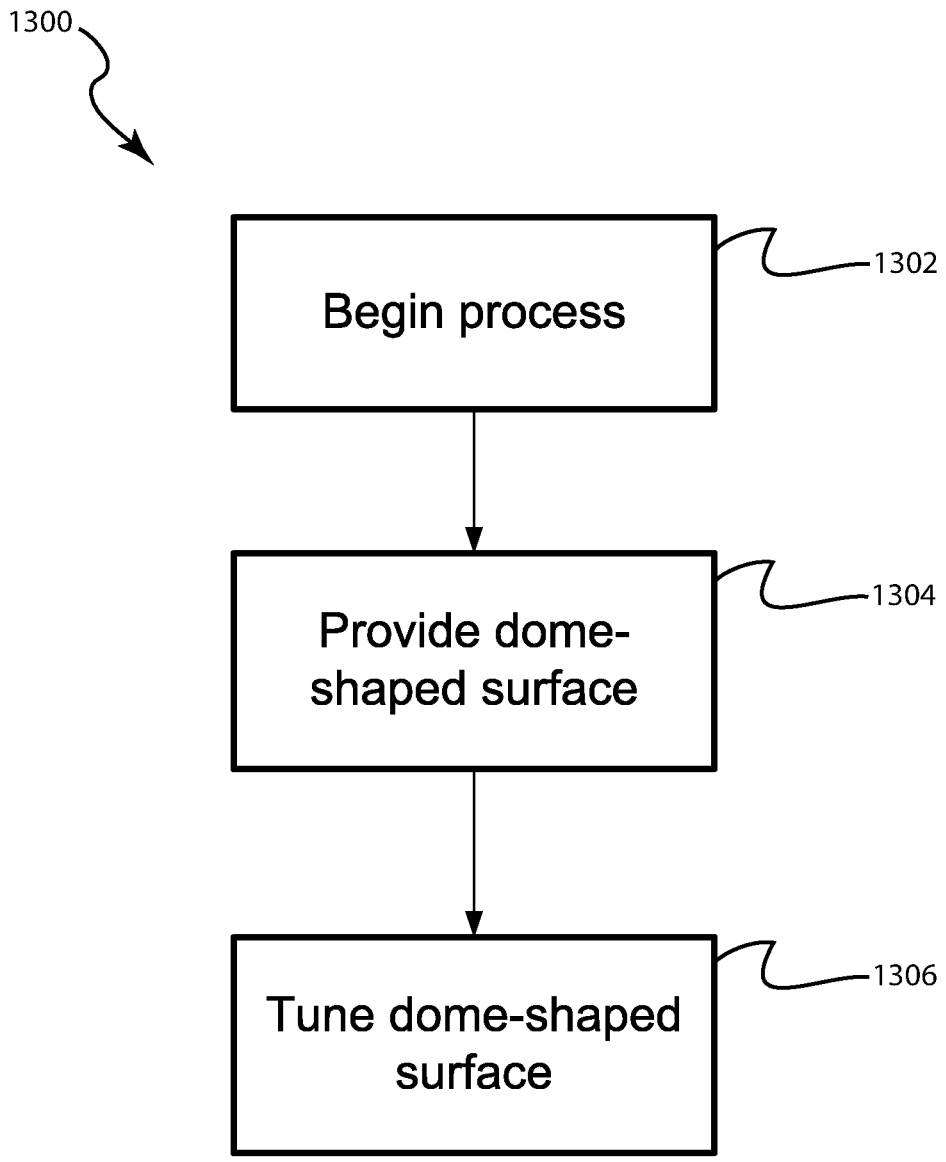
FIG. 13 is an illustrative process of providing the low travel dome of FIG. 2, in accordance with at least one embodiment.

FIG. 13 is an illustrative process 1300 of manufacturing low travel dome 100. Process 1300 may begin at operation 1302.

At operation 1304, the process may include providing a dome-shaped surface. For example, operation 1304 may include providing a dome-shaped surface, such as domed surface 102 prior to any tuning members being integrated therewith.

At operation 1306, the process may include selectively removing a plurality of predefined portions of the dome-shaped surface to tune the dome-shaped surface to operate according to a predefined force-displacement curve characteristic. For example, operation 1306 may include forming openings or cutouts 152, 154, 156, and 158 at the plurality of predefined portions of the dome-shaped surface, each of the openings having a predefined shape, such as an L-shape or a pie shape. In some embodiments, operation 1306 may include forming a remaining portion of the dome-shaped surface that may appear to be cross-shaped. Moreover, in some embodiments, operation 1306 may include die cutting or stamping of the dome-shaped surface to create cutouts 152, 154, 156, and 158.

Figure 14:
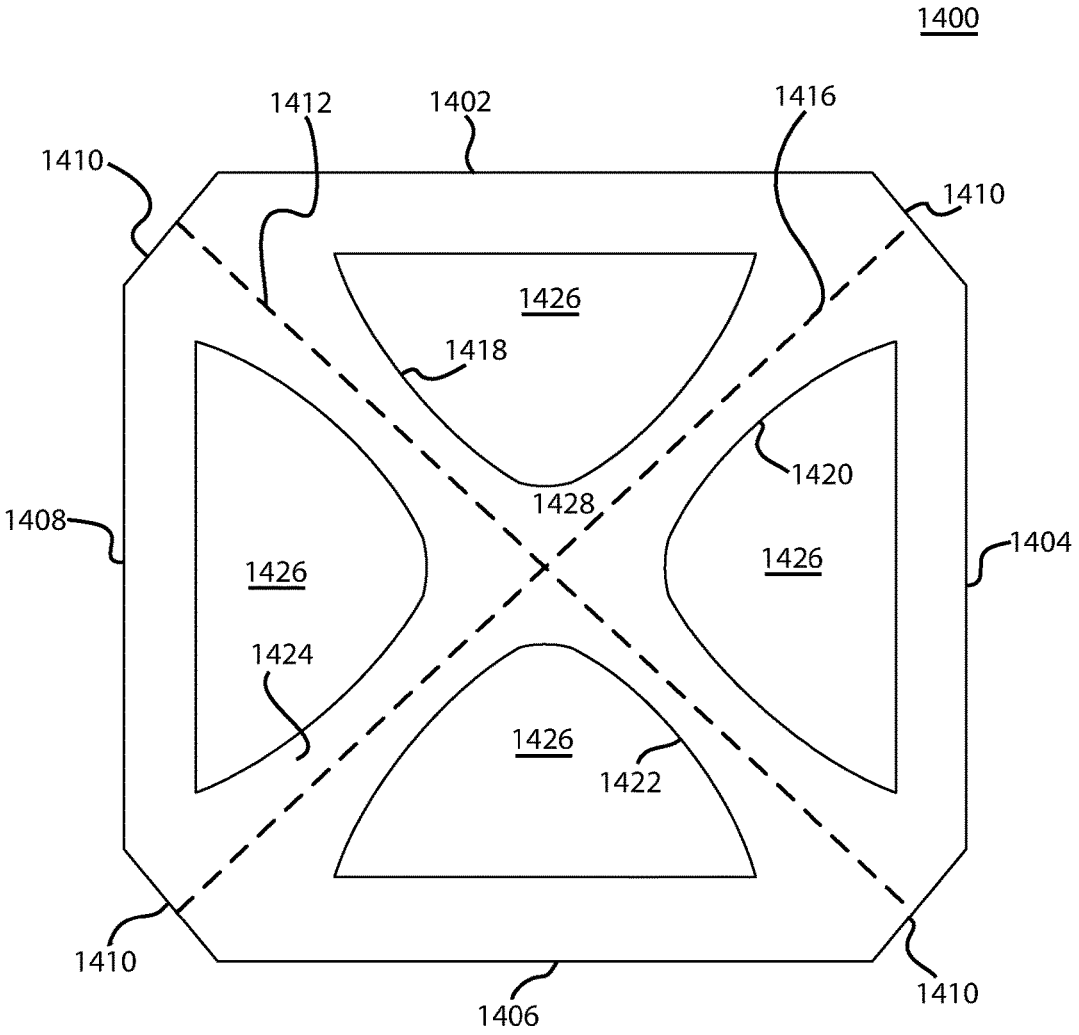
FIG. 14 is a top view of yet another sample low travel dome.

FIG. 14 illustrates yet another sample dome 1400 that may be employed in certain embodiments. This dome 1400 may be generally square or rectangular. That is, the major sidewalls 1402, 1404, 1406, 1408 may be straight and define all or the majority of an outer edge or surface of the dome 1400. The dome 1400 may have one or more angled edges 1410. Here, each of the four corners is angled. The angled corners 1410 may provide clearance for the dome 1400 during assembly of a key and/or keyboard with respect to adjacent domes, holding or retaining mechanisms, and the like. Further, the angled edges may provide additional surface contact with respect to an underlying membrane, thereby providing additional area to secure to the membrane in some embodiments. It should be appreciated that alternative embodiments may omit some or all of the angled edges 1410. Square and/or partly square bases, such as the one shown in FIG. 14, may be employed with any of the foregoing embodiments. Likewise, in some embodiments, a circular base (or base having another shape) may be employed with the arm structure shown in FIG. 14.

As shown in the embodiment of FIG. 14, two beams 1412, 1414 may extend between diagonally opposing angled edges 1410 (or corners, if there are no angled edges). Alternative embodiments may include more or fewer beams. Each beam 1412, 1416 may be thought of as being formed by multiple arms 1418, 1420, 1422, 1424. The arms 1418, 1420, 1422, 1424 meet at the top 1428 of the dome 1400. The shape of the arms may be varied by adjusting the amount of material and the shape of the material removed to form the tuning members 1426, which are essentially voids or apertures formed in the dome 1400. The interrelationship of the tuning members 1426 and beams/arms to generate a force-displacement curve has been previously discussed.

By employing a dome 1400 having a generally square or rectangular profile, the usable area for the dome under a square keycap may be maximized. Thus, the length of the beams 1412, 1416 may be increased when compared to a dome that is circular in profile. This may allow the dome 1400 to operate in accordance with a force-displacement curve that may be difficult to achieve if the beams are constrained to be shorter due to a circular dome shape. For example, the deflection of the beams (in either an upward or downward direction) may occur across a shorter period, once the necessary force threshold is reached. This may provide a crisper feeling, or may provide a more sudden depression or rebound of an associated key. Further, fine-tuning of a force-displacement curve for the dome 1400 may be simplified since the length of the beams 1412, 1416 is increased.

While there have been described a low travel switch assembly and systems and methods for using the same, it is to be understood that many changes may be made therein without departing from the spirit and scope of the invention. Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. It is also to be understood that various directional and orientational terms such as "up and "down," "front" and "back," "top" and "bottom," "left" and "right," "length" and "width," and the like are used herein only for convenience, and that no fixed or absolute directional or orientational limitations are intended by the use of these words. For example, the devices of this invention can have any desired orientation. If reoriented, different directional or orientational terms may need to be used in their description, but that will not alter their fundamental nature as within the scope and spirit of this invention. Moreover, an electronic device constructed in accordance with the principles of the invention may be of any suitable three-dimensional shape, including, but not limited to, a sphere, cone, octahedron, or combination thereof.

Therefore, those skilled in the art will appreciate that the invention can be practiced by other than the described embodiments, which are presented for purposes of illustration rather than of limitation.

What is claimed is:

1. A switch assembly, comprising:

a key cap;

a domed surface disposed below the key cap and defined by an array of arms connecting a central portion of the domed surface to an outer edge of the domed surface; and an electrical membrane coupled to the domed surface opposite the key cap and operative to trigger a switch event, the electrical membrane comprising a top layer and a bottom layer, each of the top and bottom layers being coupled to a corresponding conductive gel, the conductive gel providing support to the key cap and the domed surface when the key cap displaces toward the electrical membrane, wherein the array of arms is operative to:

maintain an offset between the central portion and the electrical membrane when the electrical membrane is not triggering the switch event; and control the domed surface to operate according to a predefined force-displacement curve.

2. The switch assembly of claim 1, wherein one of the array of arms is disposed transverse to another of the array of arms.

3. The switch assembly of claim 1, wherein the domed surface comprises a substantially square base.

4. The switch assembly of claim 3, wherein the substantially square base includes at least one angled edge.

5. The switch assembly of claim 1, wherein at least two of the array of arms are separated by a cutout formed into the domed surface.

6. A low travel dome, comprising:

a domed surface having upper and lower portions, the domed surface comprising:

an array of radially-distributed arms extending between the upper and lower portions, the array of radially-distributed arms operative to control a force-displacement curve characteristic of the low travel dome, each of the arms of the array of radially-distributed arms having a length and a lateral thickness that is constant along at least a portion of the length.

7. The low travel dome of claim 6, wherein the force-displacement curve characteristic corresponds to a change in force required to displace the upper portion.

8. The low travel dome of claim 6, wherein:

the array of radially-distributed arms has a height dimension and a width dimension; and the force-displacement curve characteristic is based on at least one of the height and the width dimension.

9. The low travel dome of claim 6, wherein:

the array of radially-distributed arms has a stiffness; and the force-displacement curve characteristic is based on the stiffness.

10. The low travel dome of claim 6, wherein the array of radially-distributed arms provides tactile feedback to a user according to the force-displacement curve characteristic.

11. The low travel dome of claim 6, wherein one of the array of radially-distributed arms intersects another of the array of radially-distributed arms at the upper portion.

12. The low travel dome of claim 11, wherein the intersection of the one of the array of radially-distributed arms and the another of the array of radially-distributed arms defines a cross-shaped portion.

13. The low travel dome of claim 6, wherein the lower portion comprises one of a circle, a polygonal, a square, or an elliptical shape.

14. A method for manufacturing a low travel dome, comprising:

providing a dome-shaped surface having a top portion and a bottom portion; and selectively removing an array of predefined portions of the dome-shaped surface between the top portion and the bottom portion, thereby defining an array of arms connecting the top portion and the bottom portion, wherein:

a shape of each of the array of arms defines a force-displacement curve characteristic of the low travel dome; and the array of arms defines a cross-shaped portion of the dome-shaped surface, the array of arms each having substantially straight side edges in the cross-shaped portion of the dome-shaped surface.

15. The method of claim 14, wherein selectively removing comprises forming openings at the array of predefined portions, each of the openings having a predefined shape.

16. The method of claim 15, wherein the predefined shape is one of an L-shape or a wedge shape.

17. The method of claim 15, wherein:

each of the array of arms has a width dimension; and the width dimension is defined by the predefined shape of the openings.

18. The method of claim 17, wherein the force-displacement curve characteristic is based on the width dimension.

19. The method of claim 14, wherein the selectively removing comprises one of cutting out or stamping out the array of predefined portions.

20. The low travel dome of claim 6, wherein the radially-distributed arms are separated from each other by an array of L-shaped openings in the domed surface.

* * * * *